US007414515B2

(12) United States Patent
Hirano et al.

(10) Patent No.: US 7,414,515 B2
(45) Date of Patent: Aug. 19, 2008

(54) PTC ELEMENT

(75) Inventors: Noriaki Hirano, Tokyo (JP); Kunio Mogi, Tokyo (JP); Tsutomu Hatakeyama, Tokyo (JP); Tsukasa Kon, Tokyo (JP); Tokuhiko Handa, Tokyo (JP); Hisanao Tosaka, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/508,924

(22) Filed: Aug. 24, 2006

(65) Prior Publication Data

US 2007/0046420 A1 Mar. 1, 2007

(30) Foreign Application Priority Data

Aug. 29, 2005 (JP) ..... P2005-248171

(51) Int. Cl.
*H01C 10/48* (2006.01)

(52) U.S. Cl. ..... 338/190

(58) Field of Classification Search ..... 338/190
See application file for complete search history.

(56) References Cited

U.S. PATENT DOCUMENTS 4,937,551 A * 6/1990 Plasko ..... 338/22 R
2003/0076217 A1* 4/2003 Park et al. ..... 338/22 R

FOREIGN PATENT DOCUMENTS

| | | |
|---|---|---|
| JP | U-59-123301 | 8/1984 |
| JP | A-63-244702 | 10/1988 |
| JP | A-02-207450 | 8/1990 |
| JP | A-03-087001 | 4/1991 |
| JP | A-10-55902 | 2/1998 |
| JP | A-2002-110403 | 4/2002 |
| JP | A-2003-151804 | 5/2003 |
| JP | A-2005-11847 | 1/2005 |
| JP | A 2005-123473 | 5/2005 |

* cited by examiner

*Primary Examiner*—Elvin Enad
*Assistant Examiner*—Joselito Baisa
(74) *Attorney, Agent, or Firm*—Oliff & Berridge, PLC

(57) ABSTRACT

An object is to provide a PTC element capable of preventing lead terminals from delaminating from an element body. This PTC element 1 is a PTC element comprising an element body 10 in which an electroconductive filler is dispersed in a crystalline polymer, and a pair of terminal electrodes 12, 14 thermocompression-bonded with the element body 10 in between, wherein each of the pair of terminal electrodes 12, 14 has an overlapping region 121, 141 overlapping with the element body 10, and a nonoverlapping region 122, 142 not overlapping with the element body 10, and wherein the nonoverlapping region 122, 142 of each of the pair of terminal electrodes 12, 14 is constructed of a succession of a wide portion 122*a* a width of which is large across a direction in which the terminal electrode 12, 14 extends from the element body 10, and a narrow portion 122*b* a width of which is smaller than the width of the wide portion 122*a*.

5 Claims, 4 Drawing Sheets

PTC ELEMENT

BACKGROUND OF THE INVENTION

1. Field of the Invention

The present invention relates to a PTC (Positive Temperature Coefficient) element.

2. Related Background Art

A PTC element is known as an element for protecting a circuit element from overcurrent. The PTC element is an element that rapidly increases its positive temperature coefficient of resistance upon arrival at a specific temperature region. An example of the PTC element is the one described in Patent Document 1 (Japanese Patent Application Laid-Open No. 2005-123473).

SUMMARY OF THE INVENTION

The PTC element described in the foregoing Patent Document 1 is constructed by preparing as an element body a sheet made of an organic PTC composition in which electroconductive particles are dispersed in a crystalline polymer, and thermocompression-bonding metal strips of such metal as nickel to the front and back sides of the element body to fix them. The metal strips as lead terminals alternately project out from the element body and the projecting portions of the respective metal strips form leads.

Incidentally, the lead terminals can delaminate from the element body during a period from fabrication of the PTC element to mounting.

An object of the present invention is therefore to provide a PTC element capable of preventing the lead terminals from delaminating from the element body.

In order to achieve this object, a PTC element according to the present invention is a PTC element comprising an element body in which an electroconductive filler is dispersed in a crystalline polymer, and a pair of lead terminals thermocompression-bonded with the element body in between, wherein each of the pair of lead terminals has an overlapping region overlapping with the element body, and a nonoverlapping region not overlapping with the element body, and wherein the nonoverlapping region of each of the pair of lead terminals is constructed of a succession of a wide portion a width of which is large across a direction in which the lead terminal extends from the element body, and a narrow portion a width of which is smaller than the width of the wide portion.

Since in the present invention the wide portion and the narrow portion are formed in succession in the nonoverlapping region, the narrow portion relatively easier to bend is mainly deformed when an external force is exerted on the wide portion or on the narrow portion. Therefore, deformation of the overlapping region is alleviated, so as to prevent the overlapping region from delaminating from the element body.

In the PTC element according to the present invention, preferably, a width of the overlapping region across the aforementioned direction is equal to the width of the wide portion. Since the PTC element is formed so that the width of the overlapping region is equal to the width of the wide portion, it is easy to fabricate the lead terminals, and strength is also ensured.

In the PTC element according to the present invention, preferably, the wide portion is formed adjacently to the element body, the narrow portion is formed opposite to the element body with respect to the wide portion, and a second wide portion is formed opposite to the wide portion with respect to the narrow portion. Since each lead terminal is formed so that the narrow portion is interposed between the wide portion and the second wide portion, the narrow portion relatively easier to bend is mainly deformed when an external force is exerted on the second wide portion located outside. Therefore, when the second wide portion is located outside where a force is more likely to be applied thereto, deformation of the wide portion and the overlapping region located inside can be alleviated more effectively.

In the PTC element according to the present invention, preferably, the wide portion is formed adjacently to the element body, the narrow portion is formed opposite to the element body with respect to the wide portion, and the narrow portion is formed through to an end of each of the pair of lead terminals. Since the narrow portion is formed outside the element body, this configuration can decrease, for example, a possibility of contact of the lead terminals with another component during a mounting work. Even if a lead terminal is brought into contact with another component, its narrow portion will be mainly deformed, so as to prevent the overlapping region from delaminating from the element body.

According to the present invention, the narrow portion relatively easier to bend is mainly deformed, so as to alleviate deformation of the overlapping region. Therefore, the invention prevents the overlapping region from delaminating from the element body, i.e., prevents the lead terminals from delaminating from the element body.

THE DETAILED DESCRIPTION OF THE INVENTION

The expertise of the present invention can be readily understood in view of the following detailed description with reference to the accompanying drawings presented by a way of illustration only. Subsequently, embodiments of the present invention will be described with reference to the accompanying drawings. The same portions will be denoted by the same reference symbols as much as possible, without redundant description.

Figure 1:
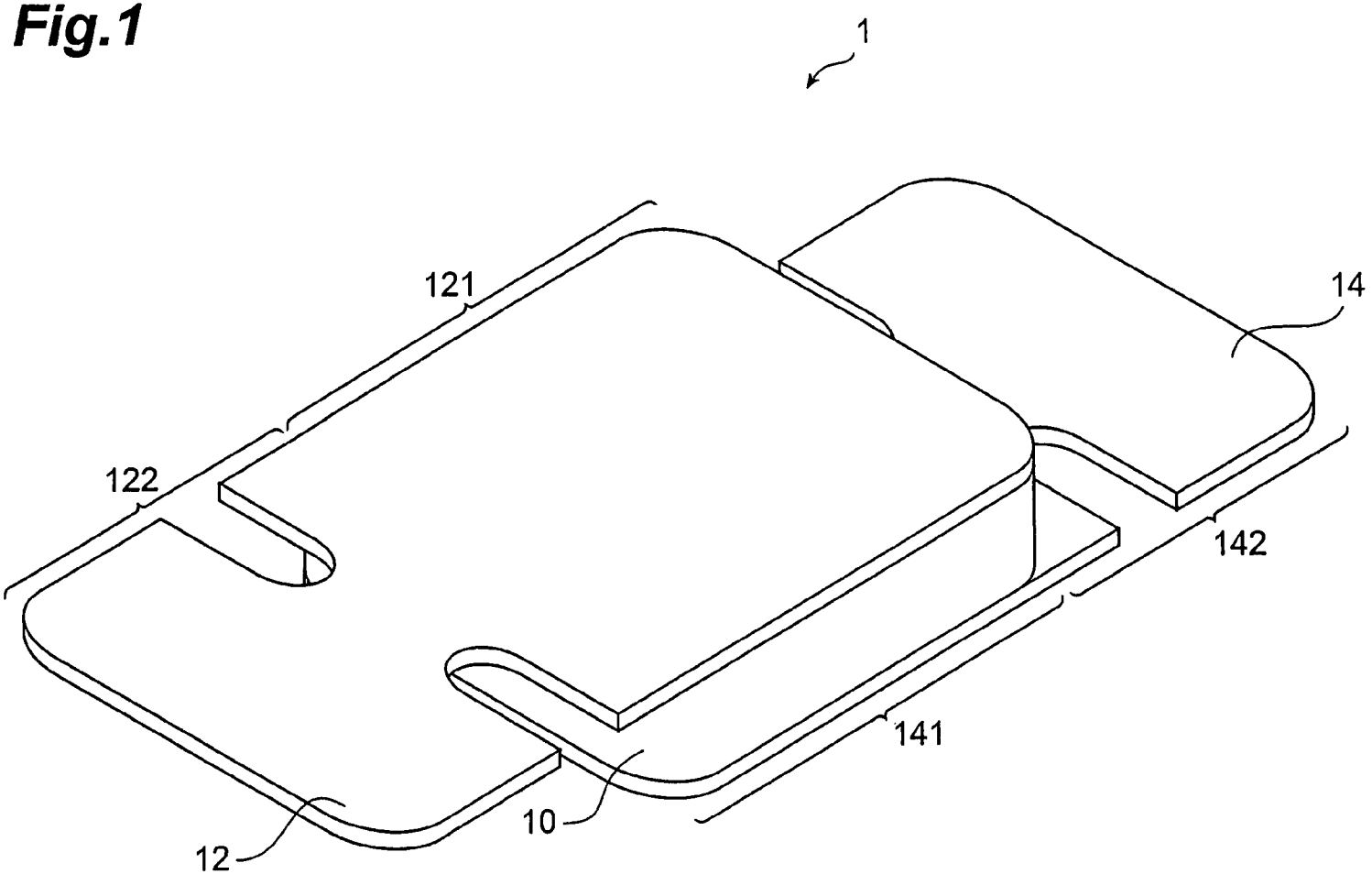
FIG. 1 is a perspective view showing a PTC element in an embodiment of the present invention.

A PTC element as an embodiment of the present invention will be described with reference to FIG. 1. FIG. 1 is a perspective view of PTC element 1. The PTC element 1 is a polymer PTC element and is comprised of a pair of terminal electrodes 12, 14 (lead terminals), and an element body 10.

The pair of terminal electrodes 12, 14 are made in the thickness of about 0.1 mm and of Ni or Ni alloy. The pair of terminal electrodes 12, 14 are arranged so that portions thereof face each other. The element body 10 is located between the facing portions. Therefore, each of the pair of terminal electrodes 12, 14 is constructed of an overlapping region 121 or 141 overlapping with the element body 10, and a nonoverlapping region 122 or 142 not overlapping with the element body 10.

The element body 10 is formed by dispersing an electroconductive filler in a crystalline polymer resin. The electroconductive filler is preferably Ni powder, and the crystalline polymer resin is preferably a polyethylene resin being a thermoplastic resin. The element body 10 is bonded to the pair of terminal electrodes 12, 14 under pressure and heat.

Figure 2:
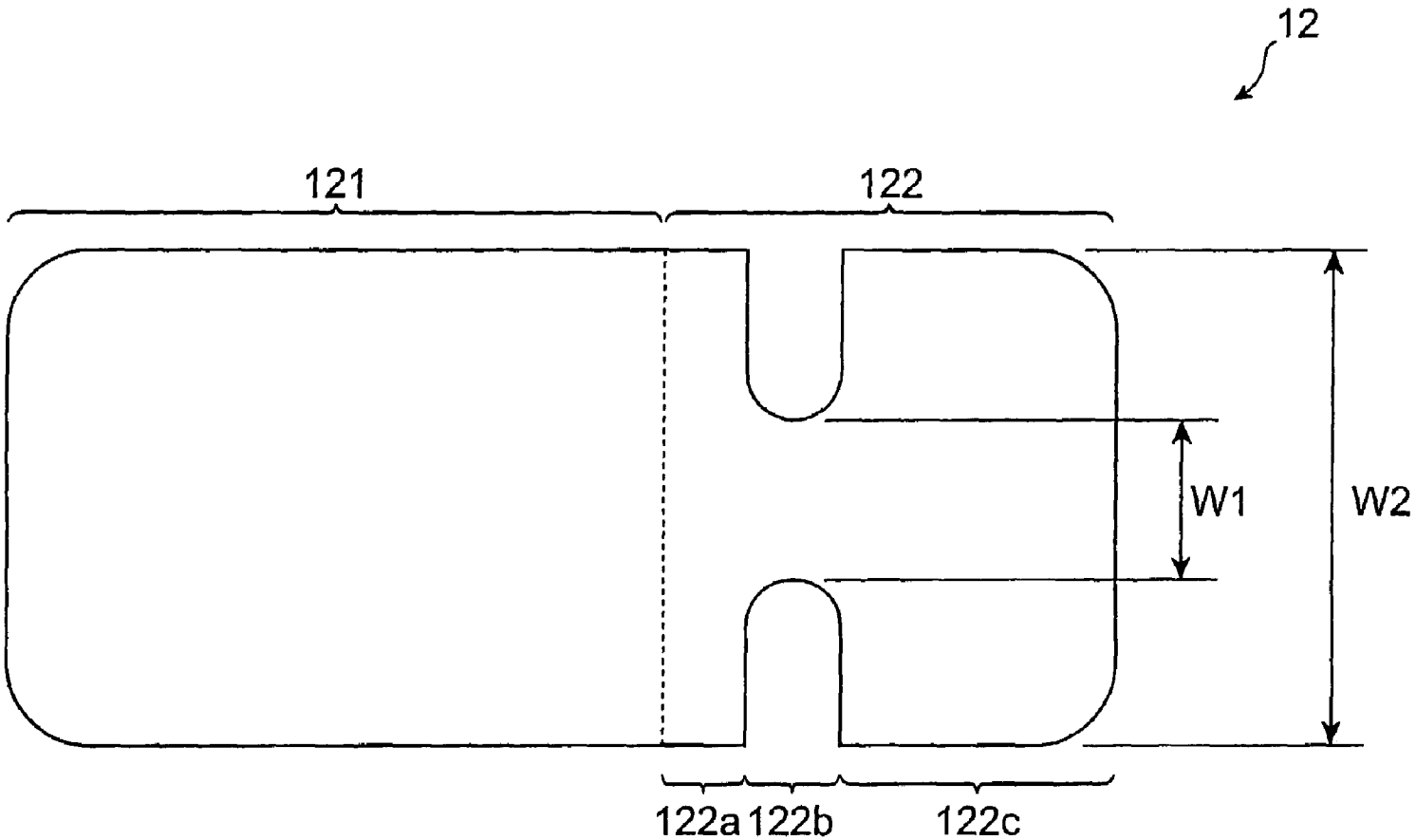
FIG. 2 is a plan view of a terminal electrode in FIG. 1.

The terminal electrodes 12, 14 will be described in detail using the terminal electrode 12 as an example. FIG. 2 is a plan view of the terminal electrode 12.

The terminal electrode 12 consists of an overlapping region 121 overlapping with the element body 10, and a nonoverlapping region 122 not overlapping with the element body 10. The nonoverlapping region 122 is formed so as to extend from the element body 10 to the outside.

The nonoverlapping region 122 consists of a wide portion 122*a*, a narrow portion 122*b*, and a wide portion 122*c* (second wide portion). The wide portion 122*a*, narrow portion 122*b*, and wide portion 122*c* are arranged in order in the direction in which the nonoverlapping region 122 extends from the element body. Therefore, the wide portion 122*a* is located adjacently to the element body 10, and the wide portion 122*c* is located on the tip side most away from the element body 10. The narrow portion 122*b* is located between the wide portion 122*a* and the wide portion 122*c*. When the wide portion 122*a* and the wide portion 122*c* are provided in this manner, the wide portion is located in the outside region of the terminal electrode 12, whereby it can secure the strength of the terminal electrode 12.

The terminal electrode 12 of the present embodiment is formed in such dimensions that the total length of the overlapping region 121 and the nonoverlapping region 122 is 6.8 mm and that the width W2 is 3.0 mm. The wide portion 122*a* has the length of 0.5 mm in the direction in which the nonoverlapping region 122 extends from the element body, the narrow portion 122*b* the length of 0.3 mm in the same direction, and the wide portion 122*c* the length of 2.0 mm in the same direction. The narrow portion 122*b* has the width W1 of 1.0-2.4 mm. The width W1 of the narrow portion 122*b* is preferably not less than one third of the width W2 of the wide portion 122*a*.

Figure 3:
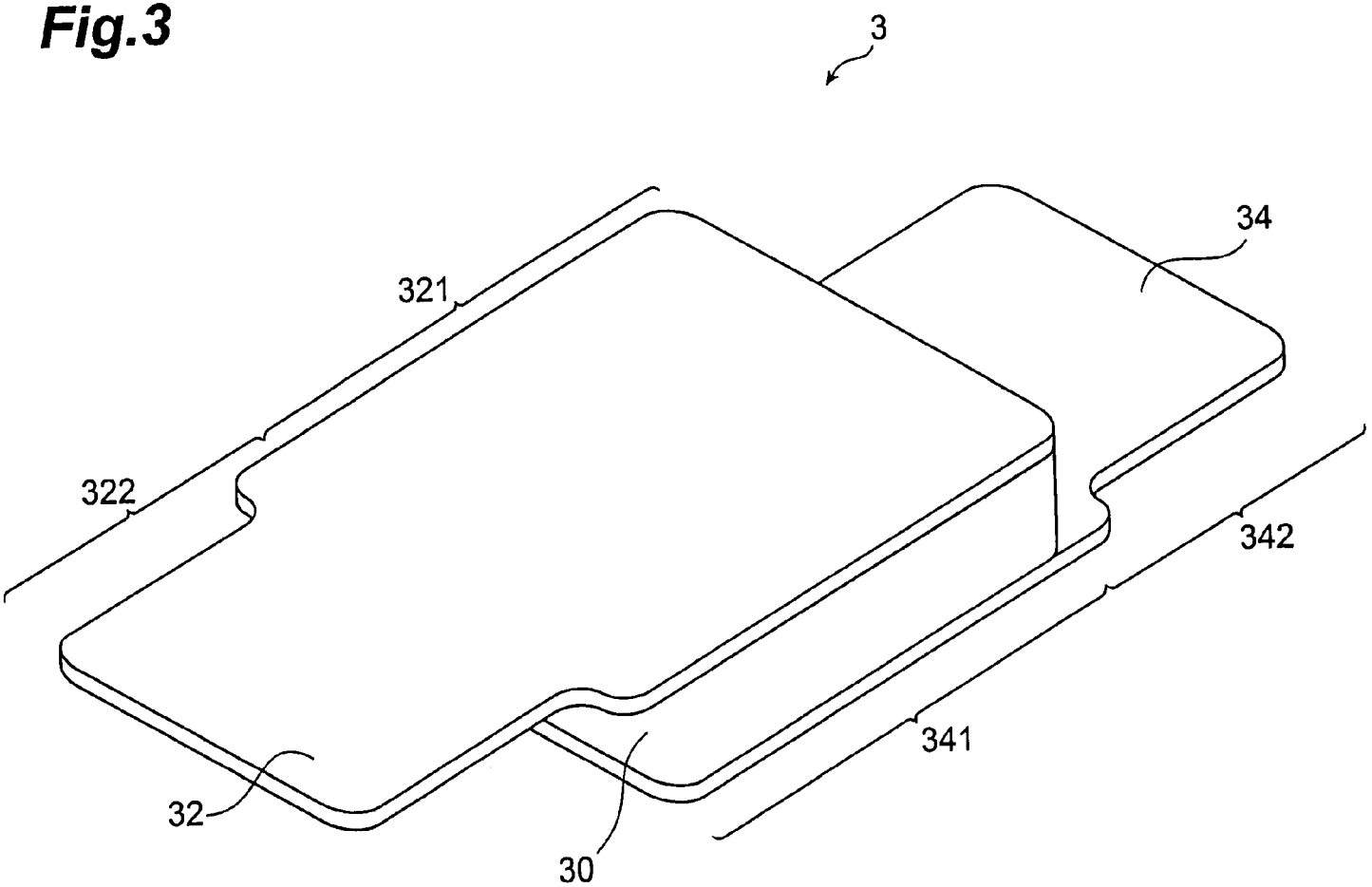
FIG. 3 is a perspective view showing a PTC element in a modification example of the embodiment of the present invention.

Subsequently, a modification example of the present embodiment will be described with reference to FIG. 3. FIG. 3 is a perspective view of PTC element 3. The PTC element 3 is a polymer PTC element and is comprised of a pair of terminal electrodes 32, 34 (lead terminals), and an element body 30.

The pair of terminal electrodes 32, 34 are made in the thickness of about 0.1 mm and of Ni or Ni alloy. The pair of terminal electrodes 32, 34 are arranged so that portions thereof face each other. The element body 30 is located between the facing portions. Therefore, each of the pair of terminal electrodes 32, 34 is constructed of an overlapping region 321 or 341 overlapping with the element body 30, and a nonoverlapping region 322 or 342 not overlapping with the element body 30.

The element body 30 is constructed by dispersing an electroconductive filler in a crystalline polymer resin as the element body 10 was. The electroconductive filler is preferably Ni powder, and the crystalline polymer resin is preferably a polyethylene resin being a thermoplastic resin. The element body 30 is bonded to the pair of terminal electrodes 32, 34 under pressure and heat.

Figure 4:
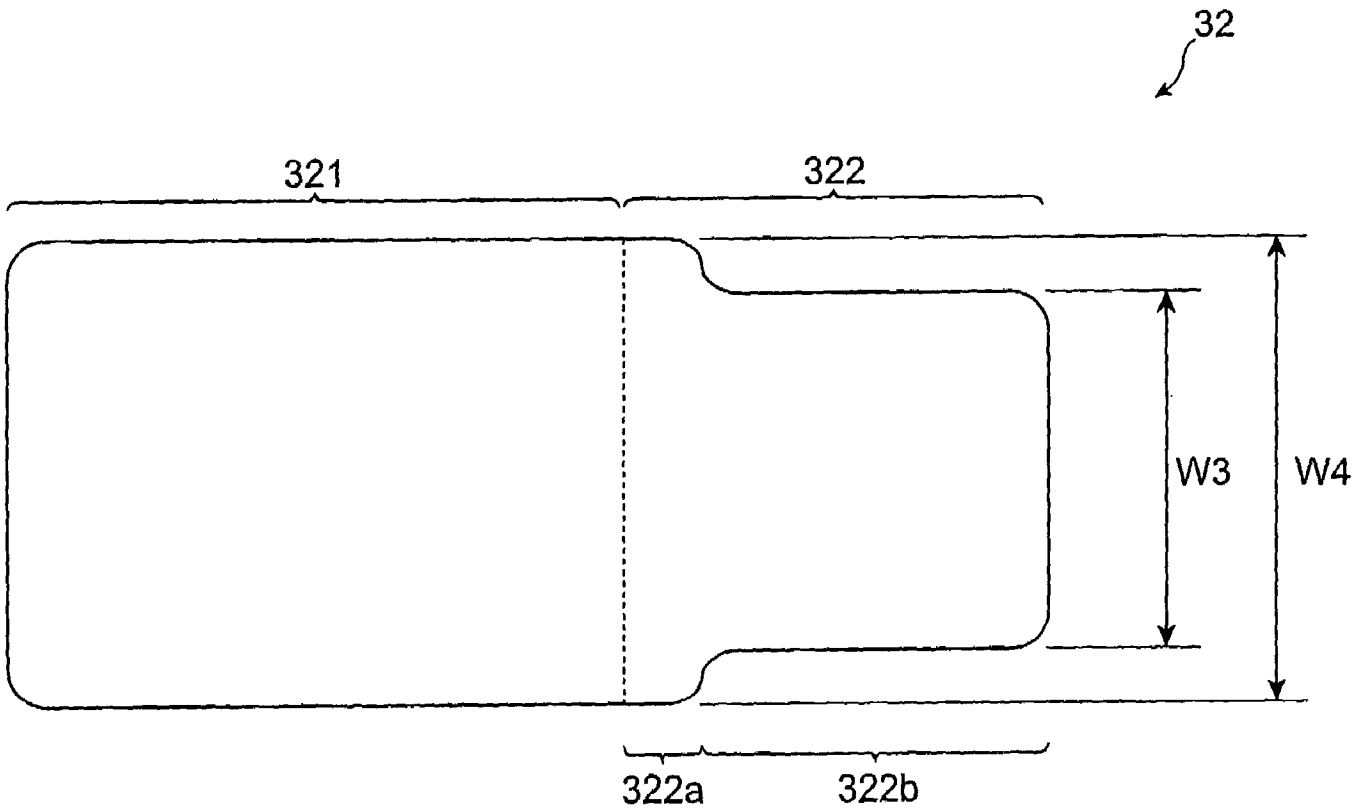
FIG. 4 is a plan view of a terminal electrode in FIG. 3.

The terminal electrodes 32, 34 will be described in detail using the terminal electrode 32 as an example. FIG. 4 is a plan view of the terminal electrode 32.

The terminal electrode 32 consists of an overlapping region 321 overlapping with the element body 30, and a nonoverlapping region 322 not overlapping with the element body 30. The nonoverlapping region 322 is formed so as to extend from the element body 30 to the outside.

The nonoverlapping region 322 consists of a wide portion 322*a* and a narrow portion 322*b*. The wide portion 322*a* and the narrow portion 322*b* are arranged in order in the direction in which the nonoverlapping region 322 extends from the element body 30. Therefore, the wide portion 322*a* is located adjacently to the element body 30, and the narrow portion 322*b* is located on the tip side of the terminal electrode 32.

The terminal electrode 32 in the modification example of the present embodiment is formed is such dimensions that the total length of the overlapping region 321 and the nonoverlapping region 322 is 6.8 mm and that the width W4 is 3.0 mm. Furthermore, the length of the narrow portion 322*b* in the direction in which the nonoverlapping region 322 extends from the element body is 2.3 mm. The width W3 of the narrow portion 322*b* is 2.3 mm.

Subsequently, a production method of the aforementioned PTC element 1 will be described. Since the PTC element 3 is different only in the shape of the terminal electrodes from the PTC element 1, a production method thereof will not be described herein. The production method of the PTC element 1 consists of an element body fabrication step, an arrangement step, and a terminal connection step.

The element body fabrication step is a step of fabricating an element material for the element body 10. First, Ni powder as an electroconductive filler is mixed with polyethylene as a matrix resin to obtain a block. This block is pressed into a disk shape and cut to obtain an element material.

The next arrangement step is to prepare the pair of terminal electrodes 12, 14 and the element material. The narrow portions 122*b* of the terminal electrodes 12, 14 may be formed by etching or by punching.

Thereafter, they are arranged so that the overlapping region 121 of the terminal electrode 12 and the overlapping region 141 of the terminal electrode 14 face each other and so that the nonoverlapping region 122 of the terminal electrode 12 and the nonoverlapping region 142 of the terminal electrode 14 extend on the sides opposite to each other. On this occasion, the element material is placed between the overlapping region 121 and the overlapping region 141.

The subsequent terminal connection step is to press the pair of terminal electrodes 12, 14 toward the element material and to heat them to bond the pair of terminal electrodes 12, 14 to the element material. If the element material is compressed to protrude out of the overlapping region 121 and the overlapping region 141, the element material in the protruding portion will be removed. This step may be conducted by applying pressure with heating, or by applying pressure after heating.

Since the PTC element 1 (3) of the present embodiment has the nonoverlapping region 122 (322) consisting of a succession of the wide portions 122*a*, 122*c* (322*a*) and the narrow portion 122*b* (322*b*), the narrow portion 122*b* (322*b*) relatively easier to bend is mainly deformed when an external force is applied to the wide portion 122*a*, 122*c* (322*a*) or to the narrow portion 122*b* (322*b*). Therefore, deformation of the overlapping region 121 (321) is alleviated and thus the overlapping region 121 (321) can be prevented from delaminating from the element body 10 (30).

Furthermore, in order to confirm the effect of the present embodiment, a comparison was made among the PTC element 1 shown in FIG. 1, the PTC element 3 shown in FIG. 3, and the conventional PTC element without the narrow portion (not shown). The comparison was made by a method of capturing the both ends of each PTC element, twisting the element, and measuring an angle at a point where the resistance increased 20% from that before deformation. This is based on the following fact: deformation of the PTC element increases according to a twist, occurrence of work hardening increases the resistance, and deformation states can be compared according to the resistance.

The comparison results were as follows. In the case of the PTC element 1, the twist angle to the 20% increase of resistance from that before deformation was about 60° in the case where the width W1 in FIG. 2 was 1.5 mm, and about 47° in the case where the width W1 in FIG. 2 was 2.00 mm. In the case of the PTC element 3, the twist angle was about 42°. In the case of the conventional PTC element (not shown), the twist angle was about 31°. It was therefore confirmed, as described above, that the terminal electrodes were unlikely to delaminate from the element body and that the influence of work hardening was also reduced in the PTC elements 1, 3 of the present embodiment.

What is claimed is:

1. A PTC element comprising an element body in which an electroconductive filler is dispersed in a crystalline polymer, and a pair of lead terminals thermocompression-bonded with the element body in between, wherein one of the lead terminals extends from a first side of the PTC element in a first direction and the other of the lead terminals extends from a second side opposite to the first side and in a second direction opposite to the first direction, wherein each of the pair of lead terminals has an overlapping region overlapping and thermocompression-bonded with the element body, and a nonoverlapping region not overlapping with the element body, wherein the nonoverlapping region of each of the pair of lead terminals has a wide portion and a narrow portion, the wide portion has a width larger than the narrow portion across a direction which the lead terminal extends from the element body, the narrow portion has a width smaller than the wide portion across said direction, wherein the wide portion and the narrow portion are adjacent each other and located in a same plane, and wherein the overlapping region and the narrow portion are located on opposite sides of the wide portion, wherein a width of the overlapping region across said direction is equal to the width of the wide portion.

2. The PTC element according to claim 1, wherein the wide portion is formed adjacently to the element body and the narrow portion is formed opposite to the element body with respect to the wide portion, wherein the nonoverlapping region of each of the pair of lead terminals has a second wide portion, the second wide portion has a width larger than the narrow portion across said direction, and wherein the wide portion and the second wide portion are located on opposite sides of the narrow portion.

3. The PTC element according to claim 1, wherein the wide portion is formed adjacently to the element body and the narrow portion is formed opposite to the element body with respect to the wide portion, and wherein the narrow portion is formed through to an end of each of the pair of lead terminals.

4. The PTC element according to claim 1, wherein the wide portion is formed adjacently to the element body and the narrow portion is formed opposite to the element body with respect to the wide portion, wherein the nonoverlapping region of each of the pair of lead terminals has a second wide portion, the second wide portion has a width larger than the narrow portion across said direction, and wherein the wide portion and the second wide portion are located on opposite sides of the narrow portion.

5. The PTC element according to claim 1, wherein the wide portion is formed adjacently to the element body and the narrow portion is formed opposite to the element body with respect to the wide portion, and wherein the narrow portion is formed through to an end of each of the pair of lead terminals.

* * * * *